US006247612B1

(12) United States Patent
Kaufman

(10) Patent No.: US 6,247,612 B1
(45) **Date of Patent: *Jun. 19, 2001**

(54) DISPENSABLE PROMOTIONAL ITEM FOR VENDING MACHINE

(75) Inventor: Mark S. Kaufman, Stamford, CT (US)

(73) Assignee: 3-Strikes Custom Design, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/097,271

(22) Filed: Jun. 15, 1998

Related U.S. Application Data

(63) Continuation-in-part of application No. 08/869,028, filed on Jun. 4, 1997, now Pat. No. 5,924,596.

(51) Int. Cl.[7] ..... G07F 11/00

(52) U.S. Cl. ..... 221/312 C; 221/1; 221/312 R; 206/457; 206/278; 206/497; 206/459.5

(58) Field of Search ..... 221/312 C, 312 R; 206/497, 457, 278, 446, 459.5; 229/87.17

(56) References Cited

U.S. PATENT DOCUMENTS

| | | | | |
|---|---|---|---|---|
| 2,614,673 | * | 10/1952 | Obodzinski | 221/265 |
| 2,990,975 | * | 7/1961 | Sereno | 221/265 |
| 3,286,831 | * | 11/1966 | Giberstein | 206/278 |
| 3,354,576 | * | 11/1967 | Gialnick | 206/278 |
| 4,205,750 | * | 6/1980 | Dews | 206/497 |
| 4,911,320 | * | 3/1990 | Howes | 206/457 |
| 5,503,274 | * | 4/1996 | Toffler et al. | 206/457 |
| 5,605,230 | * | 2/1997 | Marino et al. | 206/497 |
| 5,692,606 | * | 12/1997 | Elmaleh | 206/278 |
| 5,728,415 | * | 3/1998 | Troska | 206/457 |
| 5,791,516 | * | 8/1998 | Wittern et al. | 221/312 R |
| 5,813,538 | * | 9/1998 | Kaufman | 206/457 |
| 5,924,596 | * | 7/1999 | Kaufman | 221/312 C |

* cited by examiner

*Primary Examiner*—H. Grant Skaggs
(74) *Attorney, Agent, or Firm*—St. Onge Steward Johnston & Reens LLC

(57) ABSTRACT

A promotional item for being dispensed in a vending machine that dispenses a product item having a product within a product container upon receipt of a predetermined payment amount. The promotional item includes a product container similar to the product container of the product item, and a compressed fabric article contained within the product container and having an exterior load bearing dimension substantially equal to an interior load bearing dimension of the container. According to an embodiment of the present invention, the product container comprises a plastic bottle cut into two pieces, and the interior load bearing dimension comprises an inner diameter of the bottle. In addition, the compressed fabric article is generally cylindrical and the exterior load bearing dimension comprises an outer diameter of the compressed article. The promotional item further comprises means for securing the two pieces of the bottle together with the compressed fabric article contained therein.

15 Claims, 6 Drawing Sheets

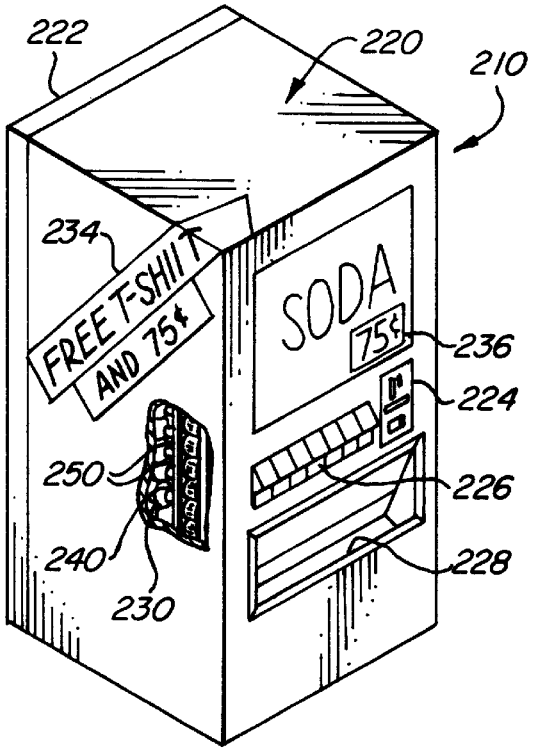
FIG. 5
FIG. 7
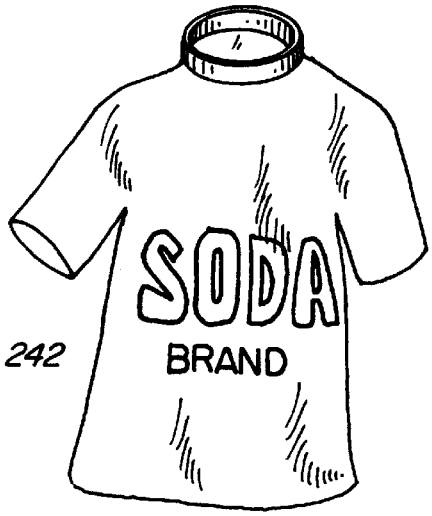
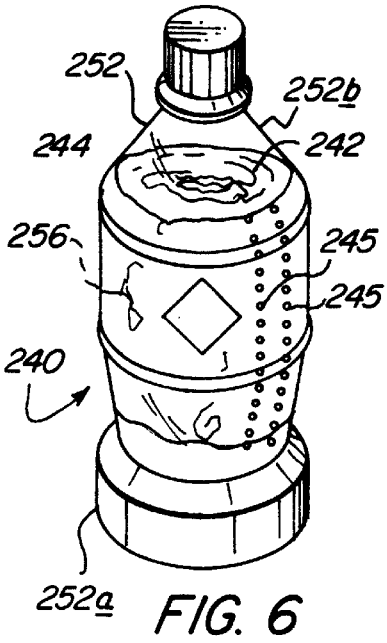
FIG. 6
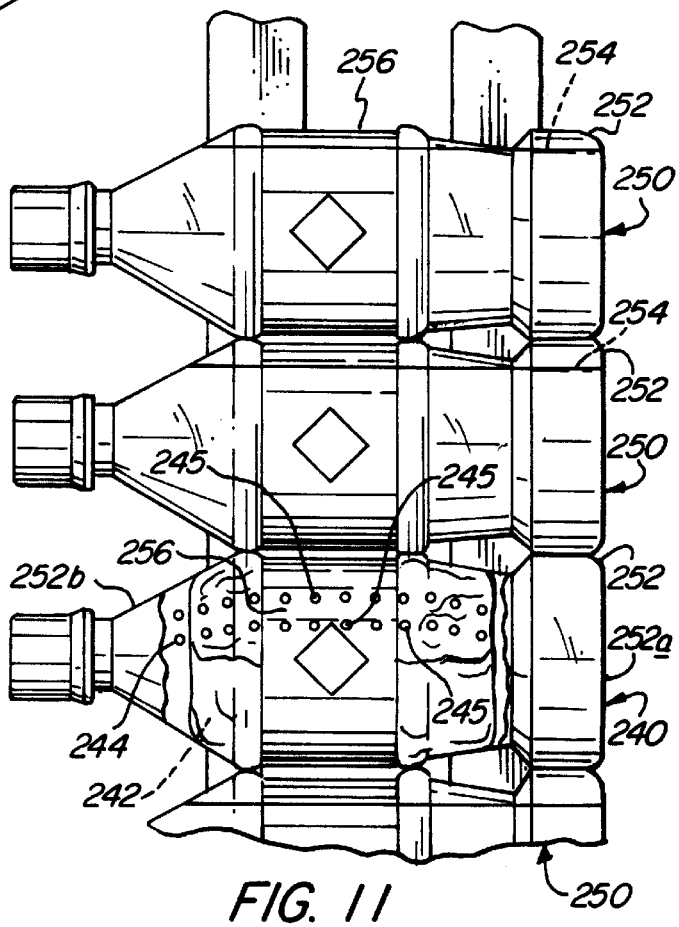
FIG. 11

DISPENSABLE PROMOTIONAL ITEM FOR VENDING MACHINE

CROSS-REFERENCE TO RELATED APPLICATIONS

The present application is a continuation in part of application Ser. No. 08/869,028 for a "Method and Apparatus for Dispensing Promotional and Product Items," filed Jun. 4, 1997 and issued as U.S. Pat. No. 5,924,596 on Jul. 20, 1999.

FIELD OF THE INVENTION

The invention relates to a method and apparatus for dispensing items upon receipt of payment, and more specifically, to a method and apparatus for dispensing promotional and product items upon receipt of payment to promote sales of the product item. Even more particularly, the present invention relates to a dispensible promotional item for a vending machine.

BACKGROUND OF THE INVENTION

Vending machines and methods of dispensing product items from vending machines are well-known in the art. For example, U.S. Pat. Nos. 3,948,416 and 4,702,392 disclose vending machines, and U.S. Pat. Nos. 5,445,287 and 5,505,332 disclose methods of dispensing product items from vending machines.

Although the prior art discloses vending apparatus that is generally useful for their limited purpose, i.e., dispensing product items upon receipt of payment, the prior art does not disclose a vending apparatus which efficiently and effectively markets the product items which it offers for sale.

The use of promotional items has proliferated in today's increasingly competitive marketplace, where companies are constantly seeking more effective and cost efficient ways to market their products to consumers. Effective marketing is oftentimes the determinative factor between failure and success for a product. The advantage to be proffered by a vending apparatus dispensing both promotional and product items is the increased sales of the product item resulting from the increased exposure created by the promotional item.

As shown in FIGS. 1–5, the parent application of the present application, co-pending patent application Ser. No. 08/869,028 for a "Method and Apparatus for Dispensing Promotional and Product Items," discloses a promotional item that is substantially the same size and shape as the product item. The promotional item is a compressed fabric article, such as a T-shirt bearing a logo of the product, containing enough money so that an actual product item can be purchased from the vending machine after receipt of the promotional item. The promotional item is very suitable for, and easily dispensed from a vending machine dispensing product items having simple sizes and shapes, such as a cylindrical soda can or a box of laundry detergent for example.

Since fabric compression technology is generally limited to such simple sizes and shapes, however, the promotional item disclosed in the parent application may not be useable in a vending machine dispensing product items having more complex sizes and shapes, such as plastic soda bottles for example. Conventional vending machines typically have at least one storage compartment of a certain width and depth for holding a stack of product items. Since the items, whether promotional or product, are stacked in the vending machine, the items have to be at least strong enough to support the weight of a full stack. In addition, the machines may be sensitive to size variations in the items dispensed, such that the promotional item should also be the same size and shape of the product item even if the shape of the product item is relatively complex. Use of a promotional item that is not strong enough to support the weight of a stack in a vending machine, and that does not have the same size and shape as the product item could jam or otherwise disrupt operation of the vending machine.

What is still needed, therefore, is a promotional item that can be dispensed from a conventional vending machine dispensing product items having sizes and shapes that are relatively complex, without jamming or otherwise interrupting operation of the vending machine.

SUMMARY OF THE INVENTION

Accordingly, it is an object of the invention to provide a method for dispensing both promotional and product items.

Another object of the invention is to provide a method for dispensing promotional and product items that have substantially the same size and shape.

Yet another object of the invention is to provide a method for dispensing promotional and product items, where the promotional item contains a monetary amount.

Still another object of the invention is to provide a method for dispensing both promotional and product items, where the promotional item displays thereon the logo and/or trademark associated with the product item.

A further object of the present invention is to provide a promotional item that can be dispensed from a conventional vending machine dispensing product items having sizes and shapes that are relatively complex, without jamming or otherwise interrupting operation of the vending machine.

These and other objects of the invention are achieved by a promotional item for being dispensed in a vending machine that dispenses a product item having a product within a product container upon receipt of a predetermined payment amount. The promotional item includes a product container similar to the product container of the product item, and a compressed fabric article contained within the product container and having an exterior load bearing dimension substantially equal to an interior load bearing dimension of the container. Whereby, the promotional item will not collapse under the weight of a stack of product items within the vending machine. In addition, since the promotional item incorporates the product container, it will have the same size and shape of the product item regardless of the complexity of the size and shape.

According to one aspect of the present invention, the promotional item further includes a product label secured to the product container.

According to another aspect of the present invention, the compressed fabric article of the promotional item has a logo and/or trademark associated with the product.

According to an additional aspect of the present invention, a preselected monetary amount equal to the predetermined payment amount is included in the product container of the promotional item.

According to a further aspect of the present invention, the product container comprises a plastic bottle cut into two pieces, and the interior load bearing dimension comprises an inner diameter of the bottle. In addition, the compressed fabric article is generally cylindrical and the exterior load bearing dimension comprises an outer diameter of the compressed article. The promotional item further comprises means for securing the two pieces of the bottle together with the compressed fabric article contained therein.

The invention and its particular features and advantages will become more apparent from the following detailed description considered with reference to the accompanying drawings.

BRIEF DESCRIPTION OF THE DRAWINGS

FIG. 5 is a perspective view of another embodiment of an apparatus for dispensing promotional and product items in accordance with the invention, where a cutaway portion reveals a stack of promotional and product items;

FIG. 6 is a T-shirt prior to being compressed for placement in a promotional item of FIG. 5;

FIG. 7 is a perspective view of a promotional item of FIG. 5;

FIG. 11 is an enlarged side elevational view of the stack of promotional and product items contained within the apparatus of FIG. 5.

DETAILED DESCRIPTION OF THE INVENTION

Figure 1:
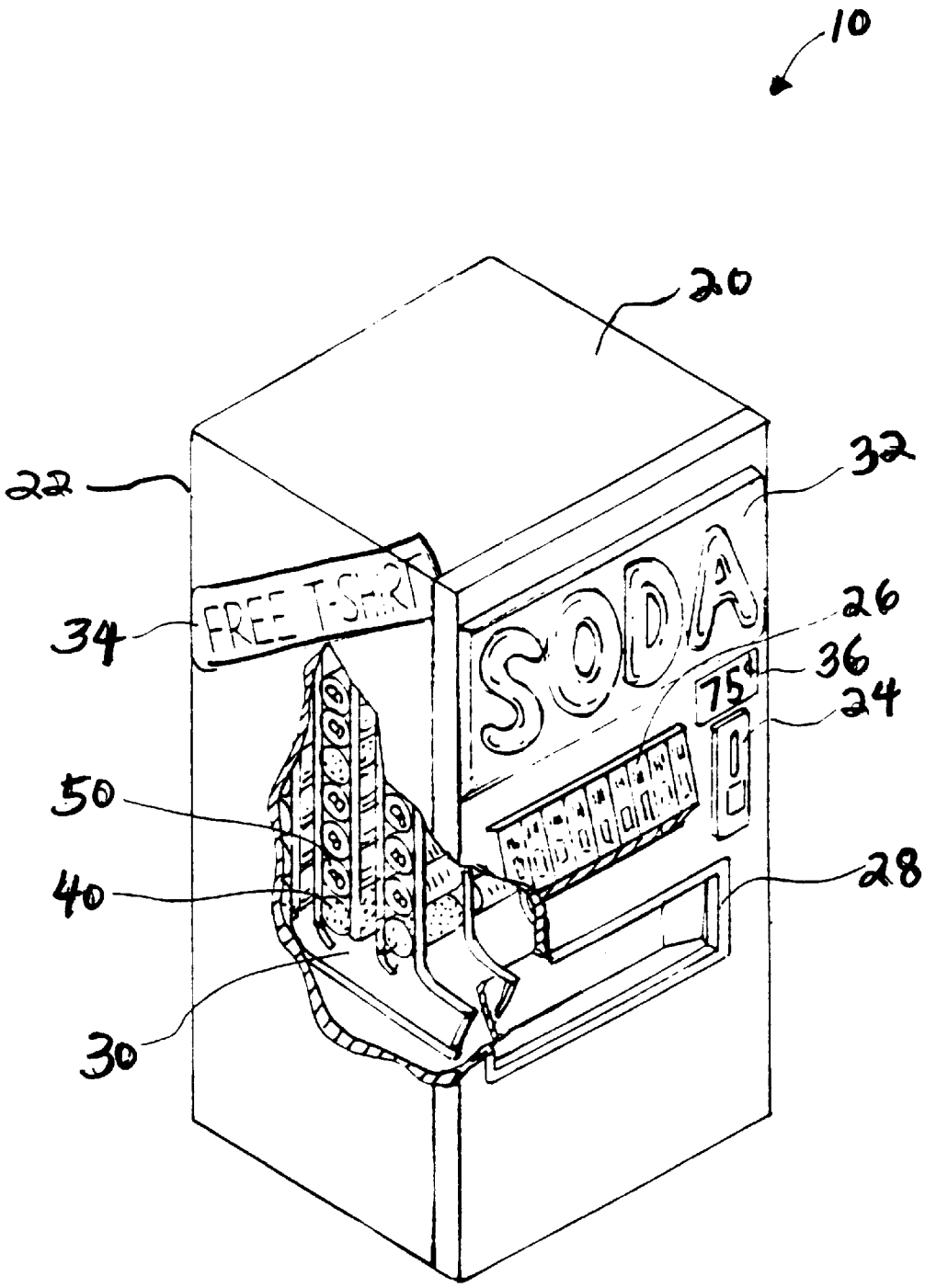
FIG. 1 is a perspective view of one embodiment of an apparatus for dispensing promotional and product items in accordance with the invention, where a cutaway portion reveals the promotional and product items.

FIG. 1 shows one embodiment of an apparatus for dispensing promotional and product items 10 in accordance with the invention, which includes an item dispensing machine 20. The item dispensing machine 20 includes a housing 22, a payment receipt mechanism 24, an item selection panel 26, an item dispensing outlet 28, and a storage compartment 30. The item dispensing machine 20 also includes a front housing member 32 which is preferably pivotally attached to the housing 22 to provide access to the interior of the item dispensing machine 20.

The storage compartment 30 is shown storing promotional items 40 as well as product items 50. As shown, the size and the shape of the promotional item 40 and the product item 50 are preferably substantially the same. This permits storage of the promotional items 40 and the product items 50 in the same storage compartment 30. Furthermore, because of the substantial similarity in size and shape of the promotional items 40 and the product items 50, these items 40, 50 may be positioned in the storage compartment 30 in any order and arrangement. However, it should be understood that vending machines are sensitive to size, product configuration, weight and weight distribution. Thus, the promotional item must be capable of being dispensed, and need not be identical in size and weight in comparison to the product.

In FIG. 1, the item dispensing machine 20 is illustrated as a soda vending machine. Accordingly, the product items 50 are soda containers, shown as cans of soda. It should be noted that the depiction of the item dispensing machine 20 as a soda vending machine is for illustrative purposes only.

Figure 2:
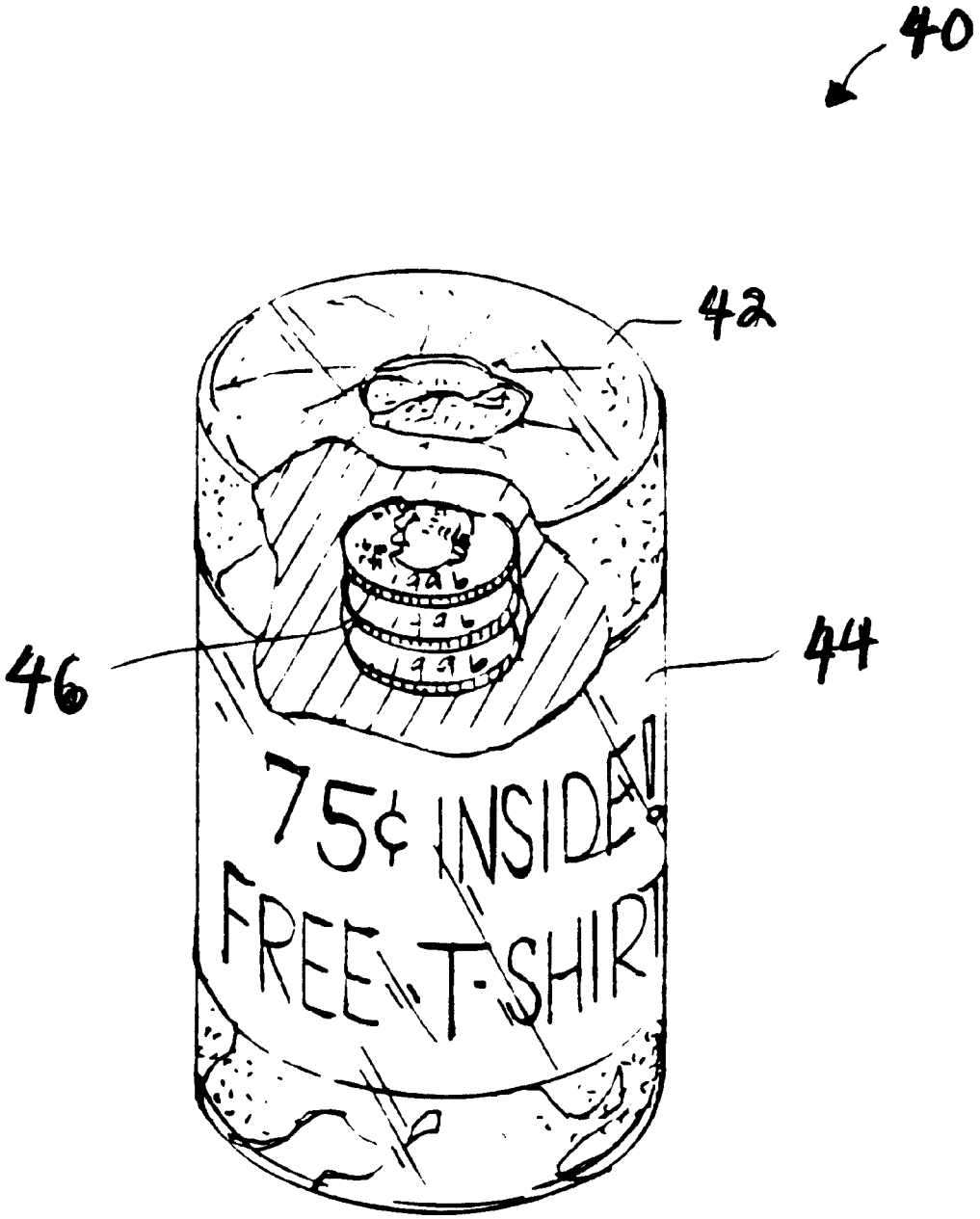
FIG. 2 is a perspective view of the promotional item of FIG. 1, where a cutaway portion reveals money contained therein.

Referring now to FIG. 2, there is shown the promotional item 40 of FIG. 1. Preferably, the promotional item 40 is a compressed fabric article bearing the logo and/or the trademark associated with the product item 50. The compressed fabric article may be, by way of example, a T-shirt, towel, hat, boxer shorts, apron, smock, socks, underwear or visor. For the embodiment of the invention shown in FIG. 1, the promotional item 40 is a compressed T-shirt, as announced by a promotional banner 34 attached to the housing 22.

The compression technology as applied to fabric articles is well-known in the art. Generally, the fabric article to be compressed is placed in a mold, and a piston under substantial pressure compresses the fabric article into the shape of a cylinder, rectangle or whatever shape the mold is designed to produce.

The promotional item 40 includes a packaging material 42 which is preferably a sheet of transparent material, such as a sheet of transparent polymeric material. This transparent material is known in the field as shrink-wrap. Also included as part of the promotional item 40 is a label 44 which has appearing thereon the marketing indicia, such as the logo and/or the trademark associated with the product item 50 (not shown). The label 44 may be positioned between the compressed fabric article and the packaging material 42 or may be positioned directly on the packaging material 42. The label is typically printed paper with the colors and logo of the product being dispensed.

Within the compressed fabric article is a preselected amount of money 46. This monetary amount 46 is incorporated into the fabric article compression process so that it is contained in the compressed fabric article. In FIG. 2, the preselected monetary amount 46 is 75 cents, which corresponds to the purchase price for the product item 50 as shown in FIG. 1 by a product price label 36. As will be described hereinbelow, the preselected monetary amount 46, while preferably equivalent to the purchase price for the product item 50, need not be so. Also, the monetary amount 46 need not take the form of cash. It may, for example, take the form of a redeemable couple for the preselected amount. Label 44 announces the amount of money contained in the compressed fabric article. The monetary amount 46 may be imbedded in the fabric article or may be placed on the exterior under the shrink-wrap material. The money 46 may be used to purchase the soda after the promotional T-shirt is received.

If a coupon or token, rather than case, is associated with the product, it is preferred that the vending machine accept the coupon or token immediately so the person purchasing the item can place the token or coupon in the vending machine and receive the desired product.

The operation of the apparatus 10 of FIG. 1 is as follows. The storage compartment 30 of the item dispensing machine 20 is loaded with both promotional 40 and product 50 items via the front housing member 32. The number and arrangement of the promotional items 40 loaded in the storage compartment 30 are determined by a person loading the items 40, 50. Preferably, this determination is based upon whatever number and arrangement of the promotional items 40 as shown by experiment will most increase the sales of the product items 50. Usually the promotional items 40 are placed randomly. The ratio of product to promotional item may vary, but a ratio between 100 to 1 and 5 to 1 provides adequate incentive for the purchaser.

When a purchaser inputs the purchase price indicated by the product price label 36 into the payment receipt mechanism 24 and makes a selection from the item selection panel 26, the next item 40, 50 in position for dispensing is dispensed to the item dispensing outlet 28. This dispensed item may be either the product item 50 or the promotional item 40.

If the item dispensed is the promotional item 40, the purchaser not only receives a free item but is also provided with money 46 with which to purchase the product item 50. As discussed above, the preselected monetary amount 46 is preferably equivalent to the purchase price for the product item 50 so that the purchaser can, following receipt of the promotional item 40, purchase the product item 50. However, the monetary amount 46 contained in the compressed fabric article may be any preselected amount.

Figure 3:
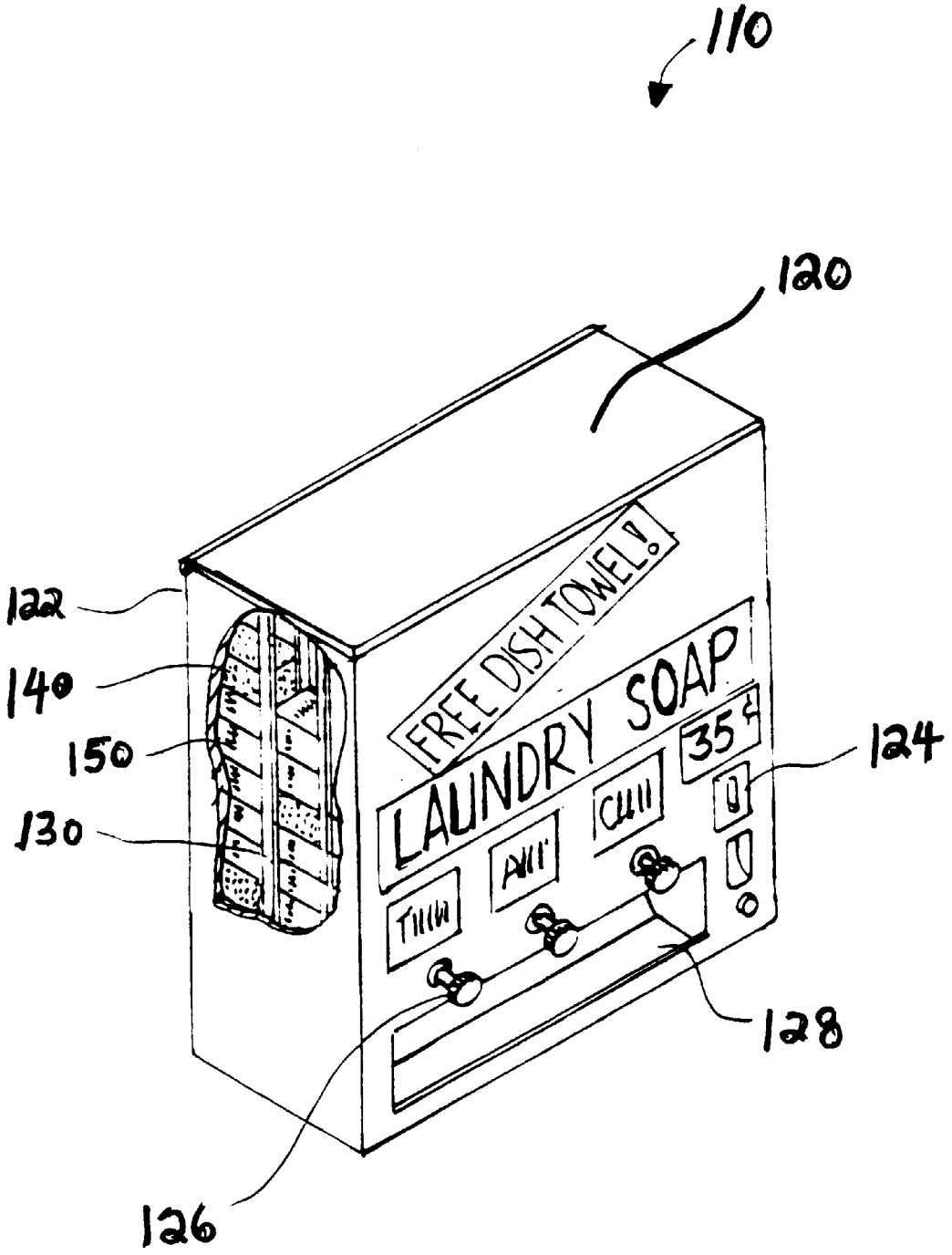
FIG. 3 is a perspective view of another embodiment of an apparatus for dispensing promotional and product items in accordance with the invention, where a cutaway portion reveals the promotional and product items.

FIG. 3 shows another embodiment of an apparatus for dispensing promotional and product items 110 in accordance with the invention. The apparatus 110 includes an item dispensing machine 120, which is depicted for illustrative purposes only as a laundry detergent dispenser. The dispenser 120 includes a housing 122, a payment receipt mechanism 124, item selectors 126, an item dispensing outlet 128, and a storage compartment 130. The storage compartment 130 stores promotional items 140 as well as product items 150. The product items 150 are illustrated as boxes of laundry detergents. The size and shape of the promotional item 140 and the product item 150 are substantially the same.

Figure 4:
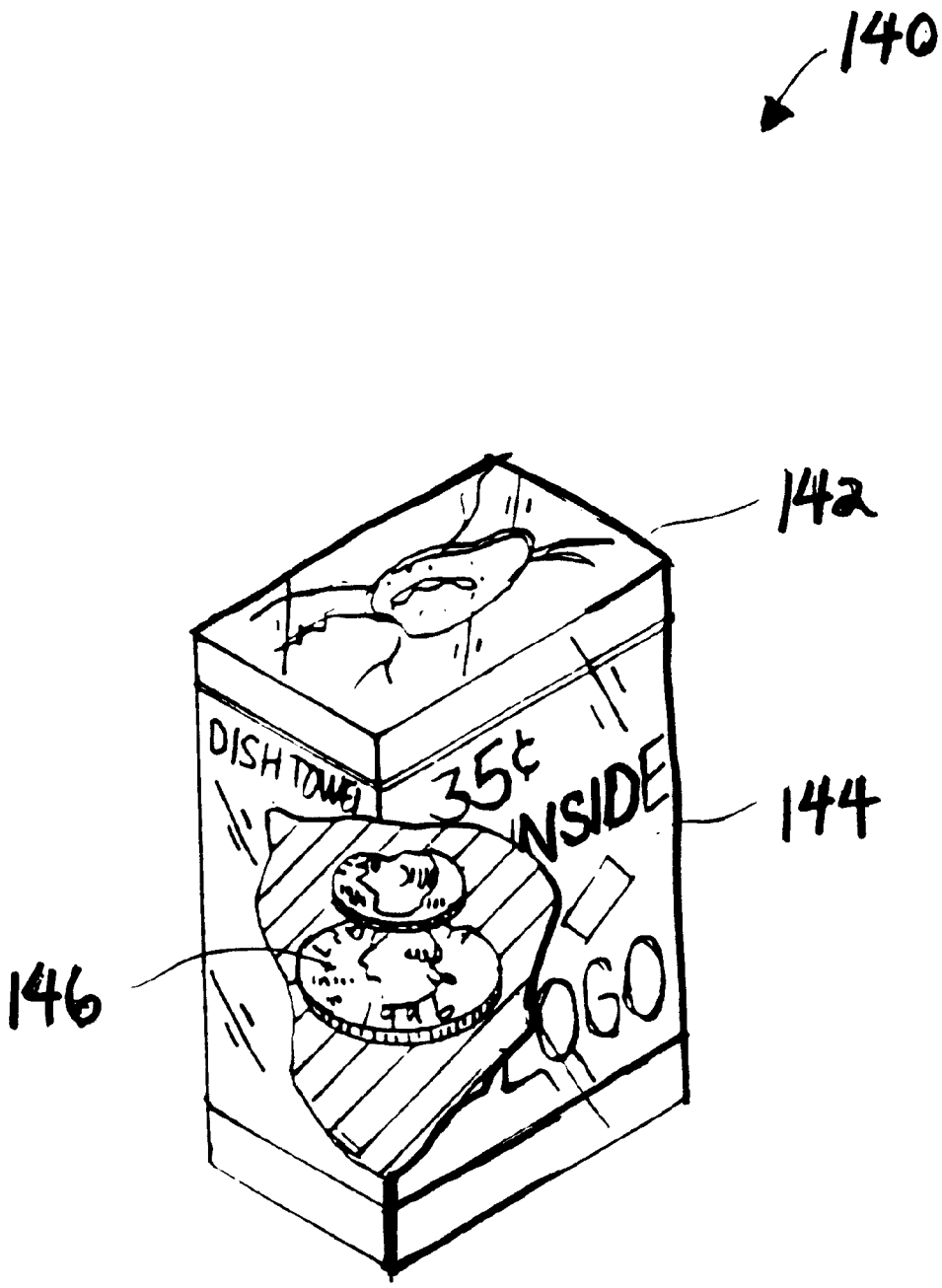
FIG. 4 is a perspective view of the promotional item of FIG. 3, where a cutaway portion reveals money contained therein.

Referring to FIG. 4, there is shown the promotional item 140 of FIG. 3. Unlike the promotional item 40 of FIG. 2, this promotional item 140 is rectangular in shape, to imitate the shape of the box of laundry detergent 150. The promotional item 140 includes a packaging material 142, preferably the sheet of transparent polymeric material, a label 144 having thereon the logo and/or the trademark associated with the product item 150, and a preselected amount of money 146, in this case 35 cents, which preferably corresponds to the purchase price for the product item 150.

The operation of the apparatus 110 of FIG. 3 is similar to the operation of the apparatus 10 of FIG. 1. Note that by providing appropriate promotional items with a wide variety of product items, various different groups of purchasers can be targeted for more effective and efficient marketing.

FIGS. 5 and 11 show an additional embodiment of an apparatus 210 for dispensing promotional items 240 and product items 250 in accordance with the invention, which includes an item dispensing machine 220. The item dispensing machine 220 includes a housing 222, a payment receipt mechanism 224, an item selection panel 226, an item dispensing outlet 228, and a storage compartment 230. The item dispensing machine 220 also includes a front housing member 232 which is preferably pivotally attached to the housing 222 to provide access to the interior of the item dispensing machine.

The storage compartment 230 is shown storing promotional items 240 as well as product items 250. As shown, the size and the shape of the promotional items 240 and the product items 250 are preferably substantially the same. This permits storage of the promotional items 240 and the product items 250 in the same storage compartment 230. Furthermore, because of the substantial similarity in size and shape of the promotional items 240 and the product items 250, these items 240, 250 may be positioned in the storage compartment 230 in any order and arrangement.

In FIG. 5, the item dispensing machine 220 is illustrated as a soda vending machine. Accordingly, the product items 250 comprise product containers, shown as generally cylindrical plastic bottles 252 containing the product, soda 254, and having a product label 256 wrapped around or otherwise stuck on the bottle. It should be noted that the depiction of the item dispensing machine 220 as a soda vending machine is for illustrative purposes only. It should also be noted that the item dispensing machine may be provided in a form other than one having the structure of vertical stacks wherein items are dispensed from the bottom of the stacks. Other types of item dispensing machines may be provided as is known. In general, however, both of the product and promotional items will be stacked or otherwise stored in the machine.

Referring now to FIGS. 6–10, there is shown the promotional item 240 of FIG. 5. Preferably, the promotional item 240 includes a compressed fabric article 242 bearing the logo and/or the trademark associated with the product item 250. The compressed fabric article may be, by way of example, a T-shirt, towel, hat, boxer shorts, apron, smock, socks, underwear or visor. For the embodiment of the invention shown in FIG. 6. the promotional item 240 includes a compressed fabric article in the form of a compressed T-shirt 242, as shown in FIG. 7 and announced by a promotional banner 234 attached to the housing 222 in FIG. 5. Alternatively, the compressed fabric article could bear the logo and/or the trademark of another product that consumers may desire. For example, Coca-Cola(™) could offer a Tommy Hilfinger(™) T-shirt in its promotional item.

The promotional item 240 also includes an empty product container, which in this embodiment is a plastic bottle 252, normally used to contain the product, soda 254. The bottle 252 is cut into two pieces 252*a*, 252*b* so that the compressed T-shirt 242, which in this embodiment has been compressed into a generally cylindrical shape, can be placed within the bottle. Preferably, the bottle 252 is radially cut through its mid-section such that the compressed T-shirt 242 can easily be placed within one of the pieces 252*a* or 252*b* of the bottle. Once the compressed T-shirt 242 is placed within one of the pieces 252*a* of the bottle 252, the other piece 252*b* of the bottle is positioned with respect to the first piece such that the bottle takes its original shape and contains the compressed T-shirt 242.

The promotional item 240 also includes a product label 256 that is wrapped around the bottle 252 just as if the promotional item were a product item 250. Since the bottle 252 is preferably cut at its mid-section, the label 256 is able to cover the cut between the two pieces 252*a*, 252*b* of the bottle. As shown, the label 256 may include adhesive for securing it around the bottle 252. Means for securing the two pieces 252*a*, 252*b* of the bottle together, with the compressed T-shirt 242 contained therein, is also provided. Preferably, the means for securing is provided in the form of a sleeve of transparent shrink-wrap 244 placed around the bottle 252 and over the label 256, and heat shrunk to secure the two piece 252*a*, 252*b* of the bottle together. The means for securing, however, could alternatively comprise transparent adhesive tape, for example. Furthermore, the label 256 could be wrapped around the shrink-wrap 244 as opposed to being positioned between the bottle 252 and the shrink-wrap. In addition, the product logo or name could be printed directly on the shrink-wrap 244 to dispense with the need for the separate label 256.

Directions for opening the promotional item may also be included on the label 256. The shrink-wrap or other means for securing the two pieces can include a separate tear strip or other means for accommodating the removal of the shrink-wrap 244 by a consumer. As shown, for example, the shrink-wrap can include rows of perforations 245 for tearing the shrink-wrap.

Preferably, the compressed fabric article 242 contains a pre-selected amount of money 246 equivalent to a purchase price 236 for the product item 250. This monetary amount 246 is incorporated into the fabric article compression process so that it is contained in the compressed fabric article 242. The monetary amount 246 need not take the form of cash, but may, for example, take the form of a redeemable coupon for the preselected amount. Label 254 announces the amount of money contained in the compressed fabric article. The monetary amount 246 may be imbedded in the fabric article or may be placed on the exterior of the compressed fabric article. The money 46 may be used to purchase the product after the promotional T-shirt is received.

Advantageously, the fabric article 242 is compressed under substantial pressure such that it is self-supporting and dimensionally stable. That is, the fabric article 242 is compressed sufficiently so that it provides all of the load-bearing integrity necessary to maintain the promotional item 240 in its original shape while supporting product items 252 when stacked within the dispensing machine 220.

Figure 8:
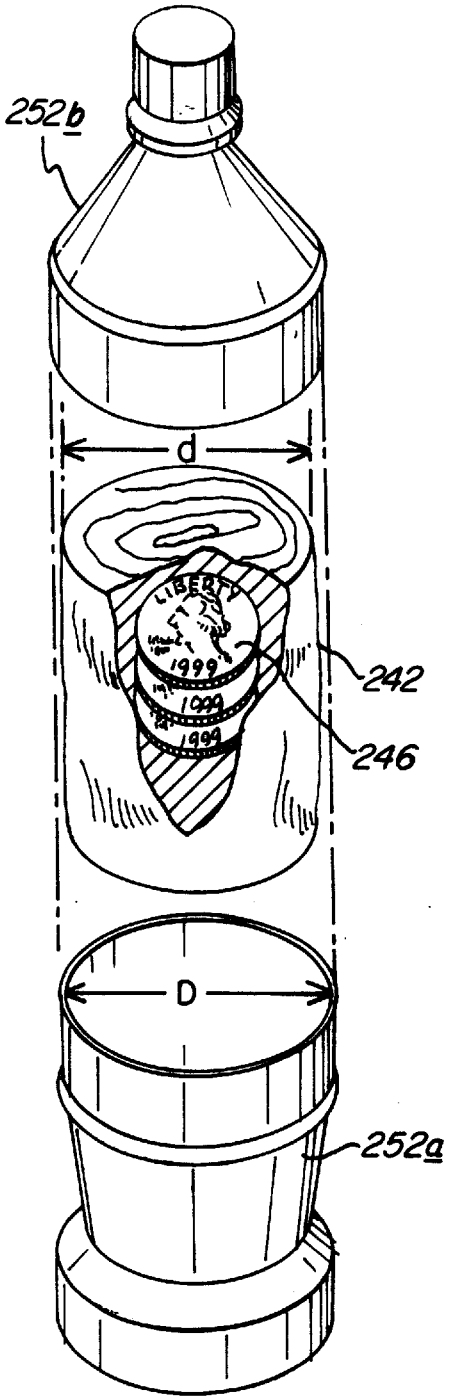
FIG. 8 is a perspective, exploded view of two pieces of a container of the promotional item of FIG. 7 and the T-shirt of FIG. 6 after being compressed, partially cut-away to revel coins contained therein.
Figure 9:
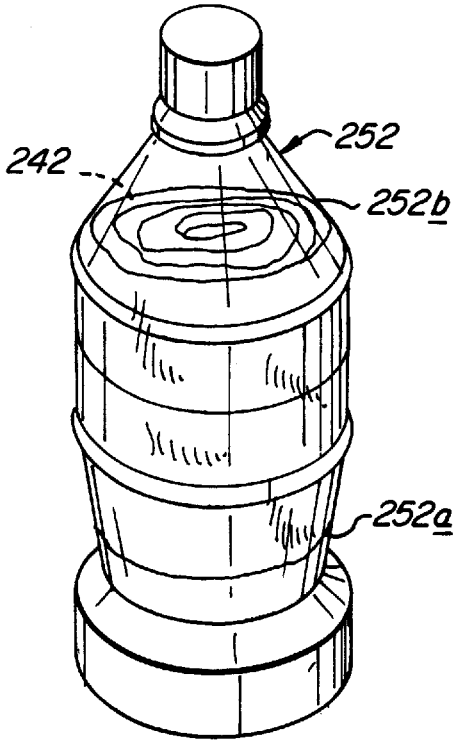
FIG. 9 is a perspective view of the two pieces of the container of the promotional item of FIG. 7 assembled with the compressed T-shirt contained therein.
Figure 10:
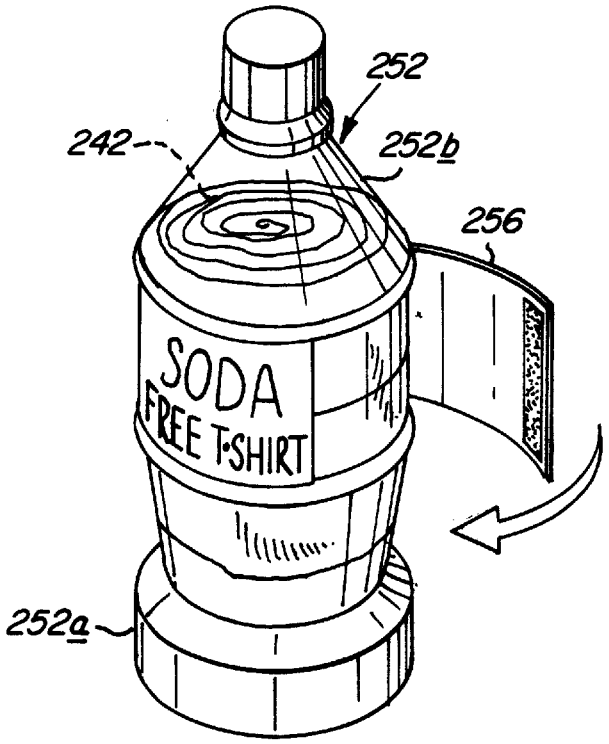
FIG. 10 is a perspective view of the two pieces of the container of the promotional item of FIG. 7 assembled with the compressed T-shirt contained therein, and a product label being secured to the container.

The compressed fabric article 242 substantially fills the bottle 252 and, as shown in FIG. 8, has an outer diameter d that is substantially the same as an inner diameter D of the bottle, such that the compressed fabric article will prevent the bottle of the promotional item 240 from collapsing when stacked with actual product items 252 within the dispensing machine 220 as shown in FIG. 11. In other words, the compressed fabric article 242 includes an exterior load bearing dimension, in this case an outer diameter d, that fills an interior load-bearing dimension, in this case an inner diameter D, of the product container 252, such that the compressed fabric article acts a load-bearing structure to prevent deformation or collapse of the product container of the promotional item 240. Since the compressed fabric article 242 is dimensionally stable and strong enough to support the weight of the stack on its own, further means for support, such as pressurization of the bottle 252 for example, are not needed.

The promotional item 240 according to the present invention, therefore, will not collapse under the weight of the stack, and jam or otherwise interrupt operation of the dispensing machine 220. In addition, since the promotional item 240 according to the present invention incorporates the actual product container 252, the promotional item will have the same size and shape of the product item 250 even if the size and shape are relatively complex, and will not jam or otherwise interrupt operation of the dispensing machine 220.

The operation of the apparatus 210 of FIG. 5 is similar to the operation of the apparatus 10 of FIG. 1 as described previously.

It is to be understood that although specific embodiments of the invention have been described herein in detail, such description is for purposes of illustration only and modifications may be made thereto by those skilled in the art within the scope of the invention.

What is claimed is:

1. An apparatus for dispensing promotional and product items, which comprises:

A) an item dispensing machine including,
- a payment receipt mechanism,
- a storage compartment, and
- a dispensing opening for dispensing items from the storage compartment upon receipt of a predetermined payment amount by said payment receipt mechanism;

B) product items stacked upon one another to form at least one column and stored for dispensing in the storage compartment, each said product item having a predetermined size and shape; and C) at lease one promotional item stored in said storage compartment among said product items, the promotional item having substantially the same predetermined size and shape of said product items and including,
- a plastic bottle cut into two pieces,
- a shrink-wrap element securing two pieces of the plastic bottle together,
- a compressed fabric article having an outer diameter at least equal to inner diameter of the plastic bottle and an outer surface which extends complementary to and continuously urges against an inner peripheral surface of the bottle along a greater part of the entire length of the bottle to partially fill said plastic bottle such that the promotional item will not collapse under the weight of other promotional items and product items within the storage compartment.

2. The apparatus of claim 1, wherein said promotional item further comprises a product label appearing thereon.

3. The apparatus of claim 1, wherein said promotional item contains a preselected monetary amount equal to the predetermined payment amount.

4. The apparatus of claim 1, wherein said compressed fabric article of said promotional item has a logo and/or trademark associated with said product item.

5. The apparatus of claim 1, wherein said promotional item contains a preselected monetary amount equal to the predetermined payment amount.

6. A method for dispensing promotional and product items from an item dispensing machine including a payment receipt mechanism, a storage compartment and a dispensing mechanism, which comprises the steps of:

placing a product item of a predetermined size and shape in said storage compartment for dispensing via said dispensing mechanism upon receipt of a predetermined payment amount by said payment receipt mechanism; and providing at least on promotional item substantially identical to the product items, said promotional item being a plastic bottle cut into two pieces;

inserting a compressed fabric article in both of the two pieces;

securing the two pieces together to completely enclose the compressed fabric article, said compressed fabric article having an outer peripheral surface which extends complementary to and urges against an inner peripheral surface of the plastic bottle along a greater part of the entire length of the bottle;

placing the one plastic bottle in said storage compartment among said product items for dispensing via said dispensing mechanism upon receipt of the predetermined payment amount by said payment receipt mechanism, the promotional item having a product container partially filled with a compressed fabric article.

7. The method of claim 6, further comprising the step of dispensing a preselected monetary amount equivalent to the preselected monetary amount along with said promotional item.

8. The method of claim 6, further comprising the step of packaging said promotional item with a label having logo and/or trademark associated with said product item appearing thereon.

9. The method of claim 6, further comprising the step of providing said compressed fabric article of said promotional item with a logo and/or trademark associated with said product item.

10. A process for dispensing product items and promotional items from a single vending machine, the process comprising steps of:

providing a vending machine having a storage compartment for storing items which have a predetermined size and shape so as to be receivable in the storage compartment of said vending machine;

placing a plurality of product items in the storage compartment of said vending machine, the product items each having a product container of substantially the same size and shape containing product; placing at least one promotional item in the storage compartment of said vending machine, the promotional item including a product container in the form of a plastic bottle having a size and shape substantially the same as the size and shape of the product containers of the product items and cut in tow parts enclosing a compressed article, which has an outer peripheral surface extending complementary to and urging against an inner peripheral surface of the plastic bottle along a greater part of the entire length thereof to have its exterior load bearing dimension substantially equal to the interior load bearing dimension of the container such that the promotional item will not collapse under the weight of a stack of product items within the vending machine;

whereby said vending machine is capable of dispensing both product items and at least one promotional item when operated by a customer.

11. A process according to claim 10, wherein the product comprises a beverage and the product containers comprise a plastic beverage bottle.

12. A vending machine for dispensing both product items and at least one promotional item received in a plurality of uniform sized and shaped product containers which are stacked upon one another, the vending machine configured to dispense said product containers and comprising:

at least one storage compartment configured to receive the stack of product containers, each having a substantially uniform inner peripheral surface;

a payment receipt mechanism;

a dispensing mechanism for dispensing the containers from the storage compartment upon receipt of a predetermined payment amount by said payment receipt mechanism;

a plurality of the product containers filled with a product; and at least one of the product container in the form of a plastic bottle cut in two attached parts and filled with a compressed fabric article to constitute the one promotional item, the compressed fabric having an outer peripheral surface extending complementary to and continuously urging against an inner peripheral surface of the plastic bottle along a greater part of the entire length of the bottle, so that the product container containing the compressed fabric article will not collapse under the weight of a stack of product items within the vending machine.

13. The vending machine of claim 12, wherein product labels are secured to the product containers.

14. The vending machine of claim 12, wherein said compressed fabric article has a logo and/or trademark associated with said product.

15. The vending machine of claim 12, wherein a preselected monetary amount equal to the predetermined payment amount is included in the product container containing the compressed fabric article.

* * * * *

UNITED STATES PATENT AND TRADEMARK OFFICE

CERTIFICATE OF CORRECTION

PATENT NO. : 6,247,612 B1
APPLICATION NO. : 09/097271
DATED : June 19, 2001
INVENTOR(S) : Mark S. Kaufman It is certified that error appears in the above-identified patent and that said Letters Patent is hereby corrected as shown below:

Claim 1, Col. 8 line 18, "c) at lease one"
should read -- c) at least one. --

Claim 6, Col. 8 line 55, "providing at least on"
should read -- providing at least one. --

Claim 10, Col. 9 line 34, "cut in tow parts"
should read -- cut into two parts. --

Signed and Sealed this

Seventh Day of October, 2008

JON W. DUDAS
*Director of the United States Patent and Trademark Office*